US006035593A

United States Patent [19]

Chao et al.

[11] Patent Number: 6,035,593

[45] **Date of Patent: *Mar. 14, 2000**

[54] TUBULAR SKYLIGHT WITH SNAP ASSEMBLY AND EXPANSION SPACER

[75] Inventors: Bing-Ling Chao, San Diego; David W. Rillie, Del Mar; Joseph W. Prenn, San Diego; Christian P. Stevens, Carlsbad, all of Calif.

[73] Assignee: Solatube International, Inc., Vista, Calif.

[ * ] Notice: This patent is subject to a terminal disclaimer.

[21] Appl. No.: 09/126,331

[22] Filed: Jul. 30, 1998

[51] Int. Cl.[7] ..... E04D 13/03

[52] U.S. Cl. ..... 52/200

[58] Field of Search ..... 52/200

[56] References Cited

U.S. PATENT DOCUMENTS

| | | | |
|---|---|---|---|
| D. 382,347 | 8/1997 | Grubb . | |
| 4,339,900 | 7/1982 | Freeman | 52/200 |
| 4,839,781 | 6/1989 | Barnes et al. . | |
| 5,099,622 | 3/1992 | Sutton . | |
| 5,467,564 | 11/1995 | DeKeyser et al. . | |
| 5,493,824 | 2/1996 | Webster et al. . | |
| 5,502,935 | 4/1996 | Demmer . | |
| 5,546,712 | 8/1996 | Bixby . | |
| 5,596,848 | 1/1997 | Lynch . | |
| 5,648,873 | 7/1997 | Jaster et al. . | |
| 5,655,339 | 8/1997 | DeBlock et al. . | |
| 5,896,713 | 4/1999 | Chao et al. | 52/200 |

OTHER PUBLICATIONS

Brochure: Capturing Renewable Energy Making It Happen! 3M Austin Ctr. Solar Optical Products, 3M Optics Technology Development. 3M Center Bldg.225–2N–06, St. Paul, MN 55144–1000. 1996.

Brochure: Daylighting Panels. Solar Optical Products, 3M Optics Technology Development. 3M Center Bldg.225–2N–06, St. Paul, MN 55144–1000. 1996.

*Primary Examiner*—Christopher T. Kent
*Attorney, Agent, or Firm*—John L. Rogitz

[57] ABSTRACT

A tube assembly of a tubular skylight is formed with upper and lower notches for respectively snappingly engaging tabs of upper and lower support rings to promote ease of installation. The upper support ring has a flange that overlaps the edge of a roof-mounted flashing such that the upper support ring rests on the flashing with the tube assembly suspended from the upper support ring. A transparent cover covers the tube assembly, and an upper seal is sandwiched between the top edge of the flashing, the cover, and the upper support ring to keep moisture and dust from entering the upper end of the skylight. Screws secure the flashing to the upper support ring, with spacers being disposed around the shanks of the screws between the heads of the screws and the flashing such that thermal expansion can be absorbed. On the lower end of the tube assembly, a dress ring supports a light diffuser, and the dress ring includes spring clips that snappingly engage receptacles on the lower support ring. Thus, the principal components are snapped together to assemble the skylight. A hollow lower seal is sandwiched between the tube assembly, diffuser plate, and dress ring such that only a single seal is required to seal the lower end of the skylight from moisture and dust.

34 Claims, 3 Drawing Sheets

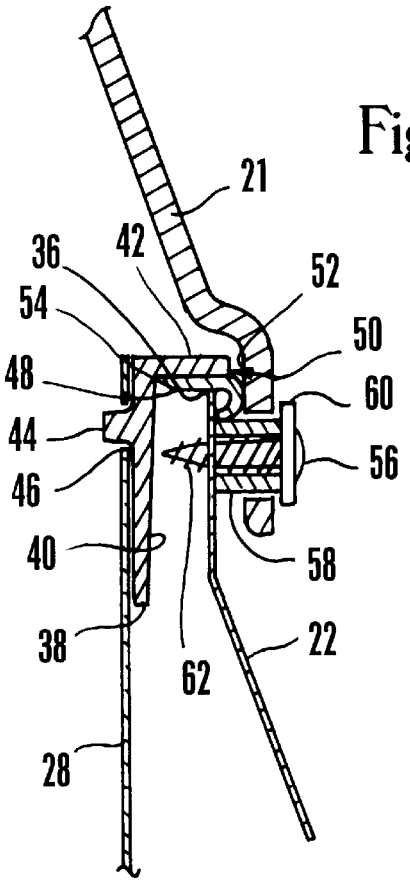
Fig. 2
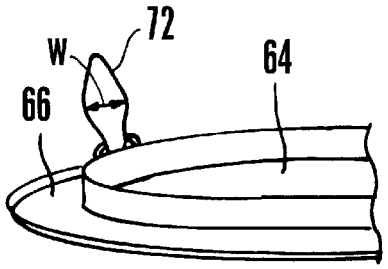
Fig. 4
Fig. 3
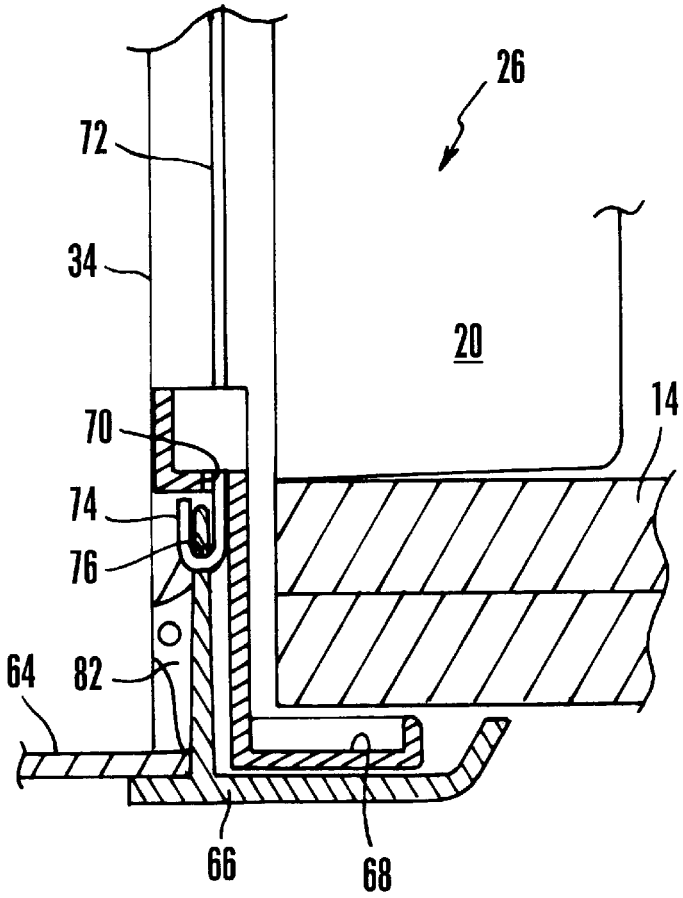

TUBULAR SKYLIGHT WITH SNAP ASSEMBLY AND EXPANSION SPACER

FIELD OF THE INVENTION

The present invention relates generally to apparatus for naturally illuminating rooms, and more particularly to tubular skylights.

BACKGROUND

In our U.S. Pat. No. 5,896,713, filed Nov. 13, 1997, owned by the same assignee as the present invention, a tubular skylight is disclosed for illuminating rooms inside buildings with natural light. As recognized therein, not only do tubular skylights save electricity and, concomitantly, are environmentally benign, but they illuminate rooms in a pleasing way using natural sunlight instead of 60 cycle electric light.

With the above in mind, the tubular skylights made by the present assignee have been commercially successful. This commercial success, however, has led to a need to provide tubular skylights that can be ever more easily and quickly installed, preferably minimizing the number of tools required to install the skylights and preferably reducing the cumbrousness of the installation procedure.

In addition to facilitating the quick and easy installation of skylights, the present invention recognizes that to ensure satisfactory skylight performance over a prolonged period, it is important to effectively seal the interior of the skylight, so that moisture and dust from inside the illuminated room and/or from the external environment does not enter the skylight and thereby reduce the light transmissive properties of the skylight. For this reason, it is important to effectively seal both the roof-mounted skylight dome to the vertical, internally-reflective tube assembly of the skylight, and to seal the room-mounted diffuser at the bottom of the tube to the tube.

As recognized by the present invention, however, many existing skylight seals are less than effective, resulting in moisture and dust entering the skylight tube and reducing its lighting capability. Also, existing seals for the bottom diffuser ordinarily require two seals, one to seal the diffuser to a bottom ring that holds the diffuser, and a second seal to seal the bottom ring to the tube assembly. As recognized by the present invention, it is desirable to minimize the number of parts that are required to seal the skylight.

Furthermore, the present invention understands that thermal stress can cause the tube to move relative to the building, and that such movement can further reduce the integrity of the skylight assembly. As recognized herein, however, it is possible to provide an expansion joint for a tubular skylight that not only absorbs thermal stress, but that also establishes an effective thermal shield.

Accordingly, the present invention addresses the above-discussed considerations.

SUMMARY OF THE INVENTION

A skylight assembly for a building includes a skylight flashing on the roof of the building, and the top edge of the flashing defines a diameter. An upper support ring has a skirt and a flange defining a diameter greater than the diameter of the top edge of the flashing, such that the flange can rest above the top edge. A skylight tube assembly is engaged with the upper support ring.

In a preferred embodiment, the skirt includes at least one radially protruding upper tab and the skylight tube assembly is formed with at least one upper notch. The notch receives the upper tab to engage the skylight tube assembly with the upper support ring. Moreover, a transparent cover covers an upper end of the tube assembly, and a light diffuser assembly covers a lower opening of the tube assembly. The diffuser assembly directs light from the tube assembly into the room. Desirably, a resilient rubber or plastic expansion seal is positioned between two segments of the tube assembly to permit longitudinal relative motion between the segments.

In accordance with the present invention, an upper seal ring is sandwiched between the skirt of the upper support ring and the transparent cover. In the preferred embodiment, the upper seal ring is formed with a cover wiper surface for contacting an inner surface of the cover and a ring wiper surface for contacting the skirt of the upper support ring, with the top edge of the flashing abutting the upper seal ring between the wiper surfaces. Thereby, a seal is established between the cover and the flashing and between the upper seal ring and the flashing. To facilitate the absorption of thermal expansion in the skylight assembly, plural fasteners, each defining a head and a shank, interconnect the cover and the flashing with a spacer being loosely disposed around the shank between the head and the flashing.

As disclosed in detail below, at the lower end of the skylight, a diffuser plate is supported by a dress ring, and the dress ring in turn is supported by a lower support ring. Per the preferred embodiment, the lower support ring is formed with plural clip receptacles, and spring clips are connected to the dress ring and are snappingly engageable with respective receptacles to hold the dress ring on the lower support ring.

Additionally, the lower support ring includes at least one radially protruding lower tab. The skylight tube assembly is formed with at least one lower notch for receiving the lower tab therein to engage the skylight tube assembly with the lower support ring.

To establish a seal between the diffuser plate and dress ring and between the dress ring and tube assembly, a lower seal ring is sandwiched between the tube assembly, dress ring, and diffuser plate. In a preferred embodiment, the lower seal ring is formed with a toroidal channel to promote compression of the lower seal ring.

In a further feature of the preferred embodiment, the lower support ring includes a support surface for abutting a lower surface of the ceiling. Flexible zip ties that define respective tie shanks are ratchetably engaged with the lower support ring. Each zip tie also is formed with a horizontal clamp extending radially away from the tie shank. The zip tie is manipulable for movement from a first position, wherein the clamp is distanced from the ceiling when the support surface abuts the lower surface of the ceiling, to a second position, wherein the clamp abuts an upper surface of the ceiling to clamp the lower support ring to the ceiling.

In another aspect, a skylight assembly for a building includes a skylight flashing on the roof of the building. An upper support ring includes a skirt formed with an upper tab, and the upper support ring is engaged with the flashing. A skylight tube assembly is formed with an upper notch for receiving the upper tab therein to snappingly engage the skylight tube assembly with the upper support ring.

In still another aspect, a skylight assembly for a building includes a diffuser plate, a dress ring supporting the diffuser plate, and a lower support ring formed with at least one clip receptacle.

At least one spring clip is connected to the dress ring and is snappingly engageable with the receptacle to hold the dress ring on the lower support ring.

In yet another aspect a skylight assembly for a building includes a diffuser plate, a dress ring supporting the diffuser plate, and a lower support ring engaged with the dress ring and including at least one radially protruding lower tab. A skylight tube assembly is formed with at least one lower notch for receiving the lower tab therein to snappingly engage the skylight tube assembly with the lower support ring.

The details of the present invention, both as to its structure and operation, can best be understood in reference to the accompanying drawings, in which like reference numerals refer to like parts, and in which:

BRIEF DESCRIPTION OF THE DRAWINGS

FIG. 2 is a partial cross-sectional view of the area indicated by circle "2" in FIG. 1;

FIG. 3 is a partial cross-sectional view of the area indicated by circle "3" in FIG. 1, showing the details of the bottom of the skylight assembly at a first location on the periphery of the assembly;

FIG. 4 is a perspective view of the diffuser and dress ring with engagement clips, with portions broken away for clarity;

DETAILED DESCRIPTION OF THE PREFERRED EMBODIMENT

References herein to orientation such as "vertical" and "horizontal" are relative to the present invention when installed in a building as shown and described.

Figure 1:
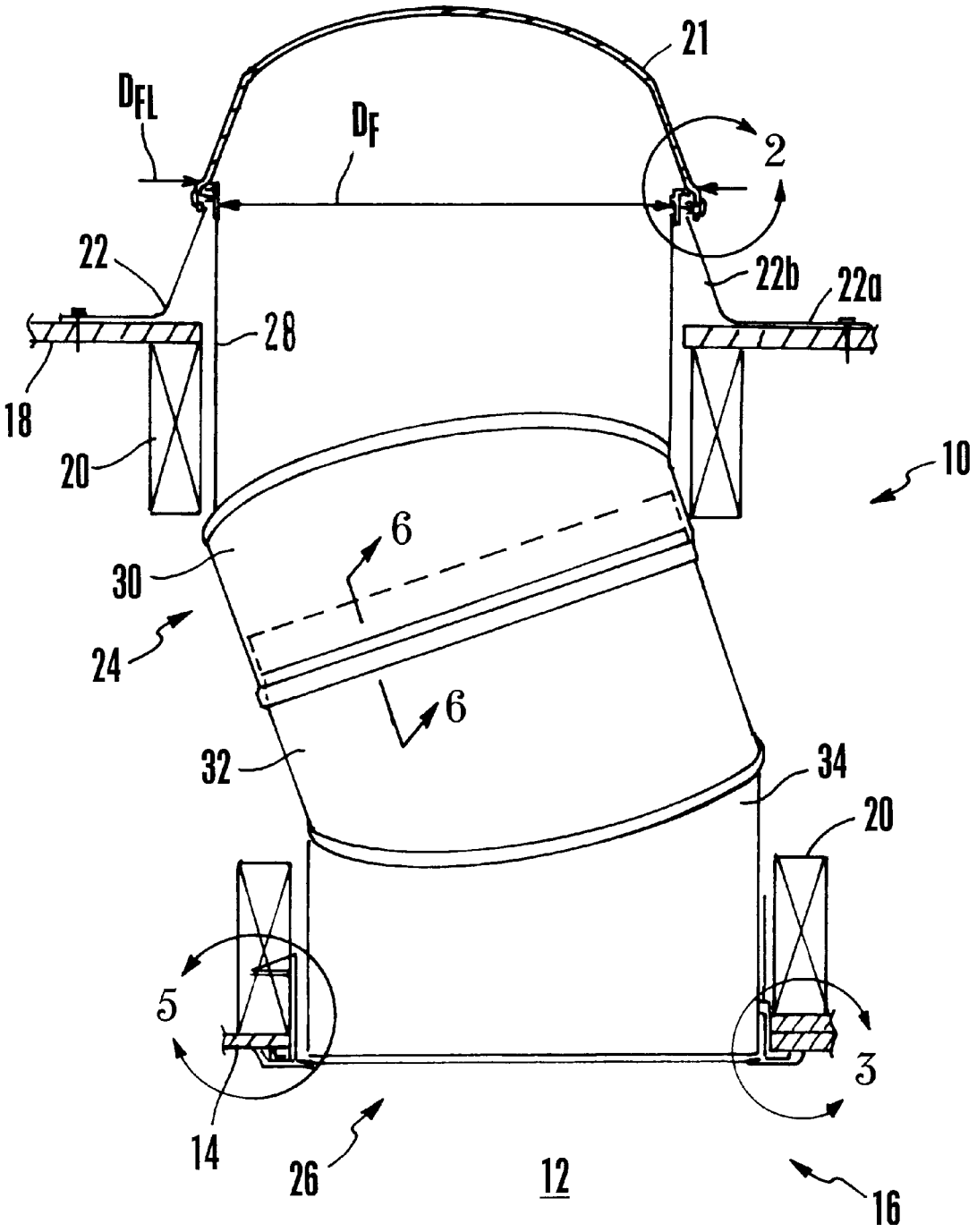
FIG. 1 is a side view in partial cross-section of the tubular skylight of the present invention.

Referring initially to FIG. 1, a tubular skylight is shown, generally designated 10, for lighting, with natural sunlight, an interior room 12 having a ceiling dry wall 14 in a building, generally designated 16. FIG. 1 shows that the building 16 has a roof 18 and one or more joists 20 that support the roof 18 and ceiling dry wall 14.

As shown in FIG. 1, the skylight 10 includes a rigid hard plastic roof-mounted cover 21. The cover 21 is optically transmissive and preferably is transparent. In one embodiment, the cover 21 can be the cover disclosed in co-pending U.S. patent application Ser. No. 08/957,513, filed Oct. 24, 1997 for an invention entitled "LIGHT-COLLECTING SKYLIGHT COVER", owned by the same assignee as the present invention and incorporated herein by reference. Or, the cover 21 can be other suitable covers, such as the covers marketed under the trade name "Solatube" by the present assignee.

The cover 21 is mounted to the roof 18 by means of a ring-like metal flashing 22. The flashing 22 includes a flat, horizontal flange 22*a* that is attached to the roof 18 by means well-known in the art, and a curb 22*b* rises upwardly from the flange 22*a* and is angled relative to the flange 22*a* as appropriate for the cant of the roof 18 to engage and hold the cover 21 in the generally vertically upright orientation shown. The curb 22*b* defines a flashing diameter $D_F$.

As further shown in FIG. 1, an internally reflective metal tube assembly, generally designated 24, is connected to the flashing 22. The tube assembly 24 extends to the ceiling 14 of the interior room 12. Per the present invention, the tube assembly 24 directs light that enters the tube assembly 24 downwardly to a light diffuser assembly, generally designated 26, in the room 12. The tube assembly 24 can be made of a metal such as a type 1150 alloy aluminum, or the tube assembly 24 can be made of fiber or plastic or other appropriate material, with the interior of the tube assembly 24 being rendered reflective by means of, e.g., electroplating, anodizing, metalized plastic film coating, or other suitable means. In one preferred embodiment, the light diffuser assembly 26, tube assembly 24, and flashing 22 are made by the present assignee.

In one preferred embodiment, the tube assembly 24 includes an upper tube 28 that is engaged with the flashing 22 and that is covered by the cover 21. Also, the tube assembly 24 includes an upper intermediate tube 30 that is contiguous to the upper tube 28 and that can be angled relative thereto if desired. Moreover, the tube assembly 24 includes a lower intermediate tube 32 that is slidably engaged with the upper intermediate tube 30 for absorbing thermal stresses in the tube assembly 24. And, a lower tube 34 is contiguous to the lower intermediate tube 32, with the bottom of the lower tube 34 being covered by the diffuser assembly 26. It is to be understood that where appropriate, certain joints between tubes can be covered with tape in accordance with principles known in the art.

Now referring to FIG. 2, the flashing 22 defines a top edge 36, and a metal or, more preferably, flexible resilient plastic ring-shaped upper support ring 38 is supported on the top edge 36. Specifically, the upper support ring 38 includes a vertical skirt 40 and a flange 42 extending radially outwardly away from the skirt 40 at the upper end thereof, with the flange 42 being disposed above the top edge 36 of the flashing 22. More specifically, referring briefly back to FIG. 1, the flange 42 defines a diameter $D_{FL}$ that is greater than the diameter $D_F$ of the top edge 36 of the flashing 22, such that when the skirt 40 of the upper support ring 38 is disposed coaxially within the flashing 22, the flange 42 extends over the top edge 36 of the flashing 22. In one embodiment, the support ring 38 is made of ABS plastic.

With this structure, no part of the upper support ring 38 need be peened or bent outwardly for the upper support ring 38 to be engaged with the flashing 22. The present invention understands that it is desirable not to deform upper support rings of skylights to facilitate engagement between the ring and flashing, as otherwise might be required without the present cooperation of structure, because such deforming wastes time and can materially fatigue or otherwise damage the support ring.

As further shown in FIG. 2, the skirt 40 of the upper support ring 38 includes at least one and preferably plural radially protruding upper tabs 44. To receive the upper tabs 44, the upper tube 28 is formed with plural upper notches 46. In the preferred embodiment, the tabs 44 are parallelepiped-shaped and are molded integrally with the upper support ring 38, with the notches 46 being rectangular-shaped notches that are cut into the upper tube 28 and that are marginally larger than the tabs 44. With this structure, the upper support ring 38 is snappingly engaged with the upper tube 28 by slightly deforming the support ring 38, juxtaposing the tabs 44 with the notches 46, and then releasing the ring 38 to permit the tabs 44 to engage the notches 46. It is to be understood that while in the preferred embodiment the tabs 44 protrude radially inwardly from the skirt 40 and the skirt 40 is disposed radially outside the upper tube 28, alternatively the tabs 44 can protrude radially inwardly from the skirt 40 and the skirt 40 received within the upper tube 28.

To establish a seal between the support ring 38, cover 21, and flashing 28, a resilient rubber or plastic ring-shaped upper seal ring 48 is sandwiched between the skirt 40 of the upper support ring 38 just below the flange 42, and the upper seal ring 48 abuts the transparent cover 21. In the preferred embodiment, the outer periphery of the upper seal ring 48 establishes a cover wiper surface 50 that contacts an inner surface 52 of the cover 21 as shown. Also, the top surface of the upper seal ring 48 establishes a ring wiper surface 54 that contacts the skirt 40 of the upper support ring 38. As shown in FIG. 2, the top edge 36 of the flashing 22 abuts the lower surface of the upper seal ring 48 between the wiper surfaces 50, 54. With this cooperation of structure, a seal is established between the cover 21, upper support ring 38, and flashing 22 by a single seal ring.

The present invention recognizes that thermal gradients can cause different rates of expansion between the different materials of the transparent rigid hard plastic cover 21 and metal flashing 22. With this consideration in mind, the present invention preferably includes plural threaded fasteners 56 with cylindrical plastic expansion spacers 58 for attaching the cover 21 to the flashing 22. In the exemplary embodiment shown, each fastener 56 defines a head 60 and a threaded shank 62, with the associated spacer 58 being loosely disposed around the shank 62 between the head 60 and the flashing 22 to facilitate the absorption of thermal expansion in the skylight assembly 10. In one preferred embodiment, each spacer 58 is made of ABS plastic.

Turning now to the bottom portion of the skylight assembly 10, FIGS. 3 and 4 show that the diffuser assembly 26 includes a plastic disc-shaped diffuser plate 64 configured in accordance with principles known in the art for diffusing light from the tube assembly 24 into the building 16. A ring-shaped plastic dress ring 66 supports the diffuser plate 64. In turn, the dress ring 66 is engaged with a plastic lower support ring 68 by convenient means.

More particularly, the lower support ring 68 is formed with at least one and preferably four clip receptacles 70, with diamond-shaped resilient metal spring clips 72 on the dress ring 66 being snappingly engaged with the receptacles 70 to suspend the dress ring 66 from the lower support ring 68. The skilled artisan will appreciate that to effect the above-described snapping engagement, the largest width "W" of each spring clip 72 is greater than the dimensionally-corresponding width of the associated receptacle 70. Accordingly, to engage the dress ring 66 with the lower support ring 68, a person in the building 16 simply lifts the dress ring 66 up toward the lower support ring 68 and snaps the spring clips 72 into the clip receptacles 74. To connect the spring clips 72 to the dress ring 66, the lower end segment 74 of each clip 72 extends through a hole 76 in the dress ring 66 and is bent into the shape of a "U" as shown.

Figure 5:
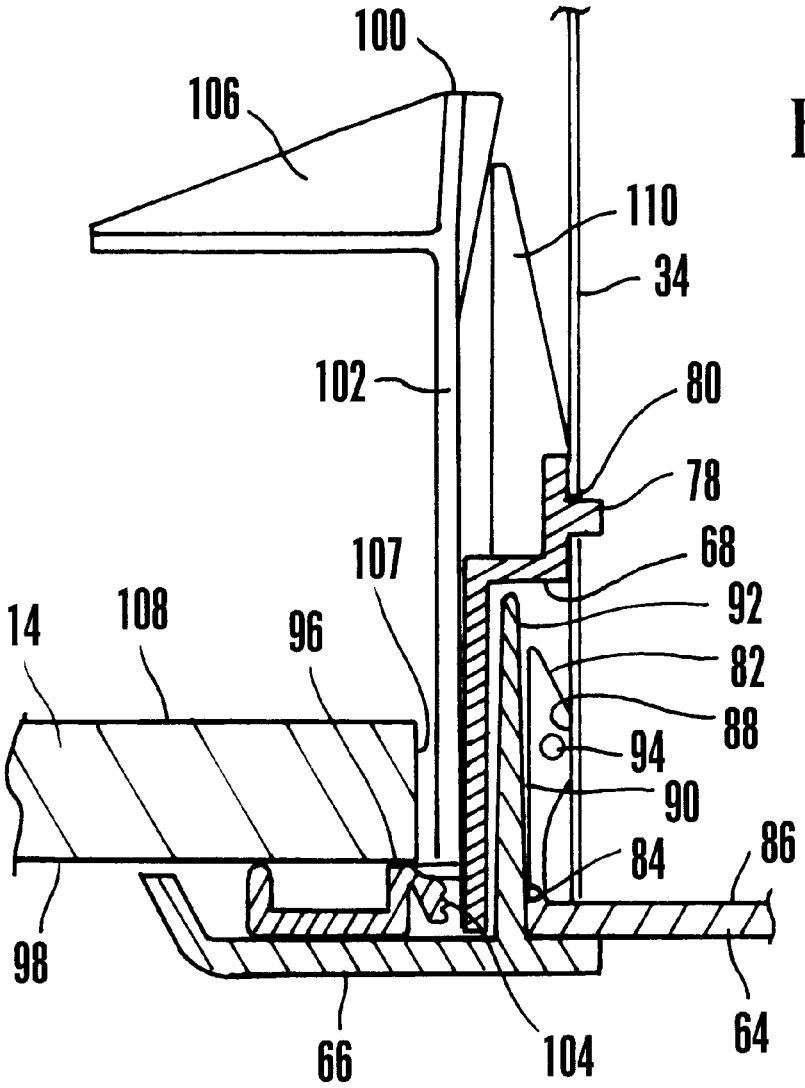
FIG. 5 is a partial cross-sectional view of the area indicated by circle "5" in FIG. 1, showing the details of the bottom of the skylight assembly at a second location on the periphery of the assembly.

Considering now how the lower support ring 68 is supported and referring to FIG. 5, the lower support ring 68 is integrally formed during molding with plural lower tabs 78. Also, the lower tube 34 is formed with respective lower notches 80 that are configured for snappingly receiving the lower tabs 78 therein to engage the skylight tube assembly 24 with the lower support ring 68. Accordingly, with the lower tube 34 in place, the lower support ring 68 is simply lifted up around the tube, deformed slightly with the lower tabs 78 juxtaposed with the lower notches 80, and then released to snappingly engage the lower support ring 68 with the tube assembly 24.

To establish a seal between the lower tube 34 and the dress ring 66, and between the dress ring 66 and the diffuser plate 64, a ring-shaped resilient rubber or plastic lower seal ring 82 is sandwiched between the lower tube 34, dress ring 66, and diffuser plate 64 as shown in FIGS. 3 and 5. More specifically, as best shown in FIG. 5 the lower periphery of the lower seal ring 82 establishes a diffuser plate wiper surface 84 that contacts a radially inner surface 86 of the diffuser plate 64. As shown, the lower seal ring 82 is generally triangular in transverse cross-section, and the right apex of the seal ring establishes a tube wiper surface 88 that contacts the lower tube 34. Further, an elongated outer surface 90 of the lower seal ring 82 extends along and contacts a vertically raised inner ring 92 of the dress ring 66. With this cooperation of structure, a seal is established between the diffuser plate 64, dress ring 66, and lower tube 34 with a single seal ring 82. In the presently preferred embodiment, to promote compression of the lower seal ring 82 and, thus, to promote the effectiveness of the seal provided thereby, a toroidal channel 94 is formed in the lower seal ring 82.

FIG. 5 further shows that the lower support ring 68 includes one or more ring-shaped support surfaces 96 that abut the lower surface 98 of the ceiling 14. In accordance with the present invention, one or more flexible plastic zip ties 100 cooperate with the support surfaces 96 to clamp the lower support ring 68 to the ceiling 14. Specifically, each zip tie 100 defines a vertically-oriented tie shank 102 that is ratchetably engaged with a ratchet channel 104 of the lower support ring 68, and a horizontal clamp 106 of the zip tie 100 extends radially outwardly away from the tie shank 102.

Using this structure, a person can advance the lower support ring 68 upwardly as described to snap the tabs 78 into the notches 80, turning the clamps 106 of the flexible zip ties 100 as appropriate to clear the periphery 107 in the ceiling 14. Once clear of the periphery 107, owing to the material bias of the zip ties 100 the clamps 106 turn back to the orientation shown in FIG. 5. Then, prior to engaging the dress ring 66 with the lower support ring 68, a person can grasp the shank 102 from below and pull the zip tie 100 down until the clamp 106 is against the ceiling 14. The portion of the shank 102 that hangs down below the ceiling 14 is then removed.

In other words, each zip tie 100 is manipulable for movement from a first position (shown in FIG. 5), wherein the clamp 106 is distanced from the ceiling 14 when the support surface 96 of the lower support ring 68 abuts the ceiling 14, to a second position, wherein the clamp abuts an upper surface 108 of the ceiling 14. Thereby, the lower support ring 68 is clamped to the ceiling 14. If desired, a respective zip tie support 110 can be provided on the lower support ring 68 next to each zip tie 100 to support the zip tie 100.

Figure 6:
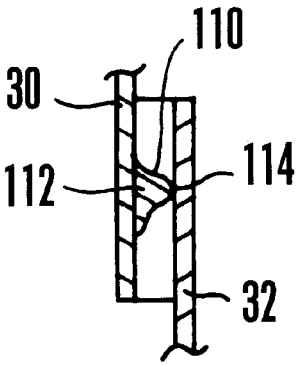
FIG. 6 is a cross-sectional view of the expansion joint as seen along the line 6—6 in FIG. 1.

Completing the present description and now referring to FIG. 6, recall that the lower intermediate tube 32 is slidably engaged with the upper intermediate tube 30 for absorbing thermal stresses in the tube assembly 24. A ring-shaped resilient rubber or plastic expansion seal 112 is positioned radially between the tubes 30, 32 to permit longitudinal relative motion between the tubes 30, 32 while establishing a more effective thermal shield therebetween than would otherwise be provided by a felt or fabric seal. In cross-section, the expansion seal 110 can be generally triangular, with a base 112 of the seal 110 establishing an inner wiper surface and an apex 114 of the seal 110 establishing an outer wiper surface.

While the particular TUBULAR SKYLIGHT WITH SNAP ASSEMBLY AND EXPANSION SPACER as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more".

What is claimed is:

1. A skylight assembly for a building having a roof, comprising:

a skylight flashing for placement on the roof, the flashing defining a top edge defining a diameter;

an upper support ring including a skirt and a flange extending radially outwardly away from the skirt, the flange defining a diameter greater than the diameter of the top edge of the flashing, such that the flange rests above the top edge; and a skylight tube assembly engaged with the upper support ring.

2. The skylight assembly of claim 1, wherein the skirt includes at least one radially protruding upper tab and the skylight tube assembly is formed with at least one upper notch for receiving the at least one upper tab therein to engage the skylight tube assembly with the upper support ring.

3. The skylight assembly of claim 1, further comprising:

a transparent cover for covering an upper end of the tube assembly; and a light diffuser assembly covering a lower opening of the tube assembly and for directing light therefrom into the room.

4. The skylight assembly of claim 3, wherein the tube assembly includes an upper tube segment and a lower tube segment, and the skylight assembly further comprises a resilient rubber or plastic expansion seal positioned radially between the segments to permit longitudinal relative motion between the segments.

5. The skylight assembly of claim 3, further comprising an upper seal ring sandwiched between the skirt of the upper support ring and the transparent cover.

6. The skylight assembly of claim 5, wherein the upper seal ring is formed with at least one cover wiper surface for contacting an inner surface of the cover and at least one ring wiper surface for contacting the skirt of the upper support ring, the top edge of the flashing abutting the upper seal ring between the wiper surfaces.

7. The skylight assembly of claim 3, further comprising:

at least one fastener defining a head and a shank, the fastener interconnecting the cover and the flashing, a spacer being disposed around the shank between the head and the flashing to facilitate the absorption of thermal expansion in the skylight assembly.

8. The skylight assembly of claim 3, wherein the diffuser assembly comprises:

a diffuser plate;

a dress ring supporting the diffuser plate;

a lower support ring formed with at least one clip receptacle; and at least one spring clip connected to the dress ring and snappingly engageable with the at least one receptacle to hold the dress ring on the lower support ring.

9. The skylight assembly of claim 8, wherein the lower support ring includes at least one radially protruding lower tab, and the skylight tube assembly is formed with at least one lower notch for receiving the at least one lower tab therein to engage the skylight tube assembly with the lower support ring.

10. The skylight assembly of claim 9, further comprising a lower seal ring sandwiched between the tube assembly, dress ring, and diffuser plate.

11. The skylight assembly of claim 10, wherein the lower seal ring is formed with a toroidal channel to promote compression of the lower seal ring.

12. The skylight assembly of claim 8, wherein the building includes a ceiling below the roof and the lower support ring includes a support surface for abutting a lower surface of the ceiling, and the skylight assembly further comprises at least one flexible zip tie defining a tie shank ratchetably engaged with the lower support ring and a horizontal clamp extending radially away from the tie shank, the zip tie being manipulable for movement from a first position, wherein the clamp is distanced from the ceiling when the support surface abuts the lower surface of the ceiling, to a second position, wherein the clamp abuts an upper surface of the ceiling when the support surface abuts the lower surface of the ceiling to thereby clamp the lower support ring to the ceiling.

13. A skylight assembly for a building having a roof, comprising:

a skylight flashing for placement on the roof, the flashing defining a top edge defining a diameter;

an upper support ring including a skirt formed with at least one radially protruding upper tab, the upper support ring being engaged with the flashing; and a skylight tube assembly formed with at least one upper notch for receiving the at least one upper tab therein to snappingly engage the skylight tube assembly with the upper support ring.

14. The skylight assembly of claim 13, wherein the upper support ring includes a flange extending radially outwardly away from the skirt, the flange defining a diameter greater than the diameter of the top edge of the flashing, such that the flange rests on the top edge.

15. The skylight assembly of claim 14, further comprising:

a transparent cover for covering an upper end of the tube assembly;

a light diffuser assembly covering a lower opening of the tube assembly and for directing light therefrom into the room; and an upper seal ring sandwiched between the skirt of the upper support ring and the transparent cover, wherein the upper seal ring is formed with at least one cover wiper surface for contacting an inner surface of the cover and at least one ring wiper surface for contacting the skirt of the upper support ring, the top edge of the flashing abutting the upper seal ring between the wiper surfaces.

16. The skylight assembly of claim 15, further comprising:

at least one fastener defining a head and a shank, the fastener interconnecting the cover and the flashing, a spacer being disposed around the shank between the head and the flashing to facilitate the absorption of thermal expansion in the skylight assembly.

17. A skylight assembly for a building having a roof, comprising:

a diffuser plate;

a dress ring supporting the diffuser plate;

a lower support ring formed with at least one clip receptacle; and at least one spring clip connected to the dress ring and snappingly engageable with the at least one receptacle to hold the dress ring on the lower support ring.

18. The skylight assembly of claim 17, wherein the lower support ring includes at least one radially protruding lower tab, and the skylight assembly includes a skylight tube assembly formed with at least one lower notch for receiving the at least one lower tab therein to engage the skylight tube assembly with the lower support ring.

19. The skylight assembly of claim 18, further comprising a lower seal ring sandwiched between the tube assembly, dress ring, and diffuser plate.

20. The skylight assembly of claim 19, wherein the lower seal ring is formed with a toroidal channel to promote compression of the lower seal ring.

21. The skylight assembly of claim 17, wherein the building includes a ceiling below the roof and the lower support ring includes a support surface for abutting a lower surface of the ceiling, and the skylight assembly further comprises at least one flexible zip tie defining a tie shank ratchetably engaged with the lower support ring and a horizontal clamp extending radially away from the tie shank, the zip tie being manipulable for movement from a first position, wherein the clamp is distanced from the ceiling when the support surface abuts the lower surface of the ceiling, to a second position, wherein the clamp abuts an upper surface of the ceiling when the support surface abuts the lower surface of the ceiling to thereby clamp the lower support ring to the ceiling.

22. The skylight assembly of claim 17, further comprising:

a skylight flashing for placement on the roof, the flashing defining a top edge defining a diameter;

an upper support ring including a skirt and a flange extending radially outwardly away from the skirt, the flange defining a diameter greater than the diameter of the top edge of the flashing, such that the flange rests on the top edge; and a skylight tube assembly engaged with the upper support ring.

23. The skylight assembly of claim 17, further comprising:

a skylight flashing for placement on the roof, the flashing defining a top edge defining a diameter;

an upper support ring including a skirt formed with at least one radially protruding upper tab, the upper support ring being engaged with the flashing; and a skylight tube assembly formed with at least one upper notch for receiving the at least one upper tab therein to snappingly engage the skylight tube assembly with the upper support ring.

24. The skylight assembly of claim 22, further comprising:

a transparent cover covering the tube assembly; and an upper seal ring sandwiched between the skirt of the upper support ring and the transparent cover, wherein the upper seal ring is formed with at least one cover wiper surface for contacting an inner surface of the cover and at least one ring wiper surface for contacting the skirt of the upper support ring, the top edge of the flashing abutting the upper seal ring between the wiper surfaces.

25. The skylight assembly of claim 22, further comprising:

a transparent cover covering the tube assembly; and at least one fastener defining a head and a shank, the fastener interconnecting the cover and the flashing, a spacer being disposed around the shank between the head and the flashing to facilitate the absorption of thermal expansion in the skylight assembly.

26. A skylight assembly for a building having a roof, comprising:

a diffuser plate;

a dress ring supporting the diffuser plate;

a lower support ring including at least one radially protruding lower tab, the lower support ring being engaged with the dress ring; and a skylight tube assembly formed with at least one lower notch for receiving the at least one lower tab therein to snappingly engage the skylight tube assembly with the lower support ring.

27. The skylight assembly of claim 26, wherein the lower support ring is formed with at least one clip receptacle, and at least one spring clip is connected to the dress ring and is snappingly engageable with the at least one receptacle to hold the dress ring on the lower support ring.

28. The skylight assembly of claim 26, further comprising a lower seal ring sandwiched between the tube assembly, dress ring, and diffuser plate.

29. The skylight assembly of claim 28, wherein the lower seal ring is formed with a toroidal channel to promote compression of the lower seal ring.

30. The skylight assembly of claim 26, wherein the building includes a ceiling below the roof and the lower support ring includes a support surface for abutting a lower surface of the ceiling, and the skylight assembly further comprises at least one flexible zip tie defining a tie shank ratchetably engaged with the lower support ring and a horizontal clamp extending radially away from the tie shank, the zip tie being manipulable for movement from a first position, wherein the clamp is distanced from the ceiling when the support surface abuts the lower surface of the ceiling, to a second position, wherein the clamp abuts an upper surface of the ceiling when the support surface abuts the lower surface of the ceiling to thereby clamp the lower support ring to the ceiling.

31. The skylight assembly of claim 26, further comprising:

a skylight flashing for placement on the roof, the flashing defining a top edge defining a diameter;

an upper support ring including a skirt and a flange extending radially outwardly away from the skirt, the flange defining a diameter greater than the diameter of the top edge of the flashing, such that the flange rests on the top edge; and a skylight tube assembly engaged with the upper support ring.

32. The skylight assembly of claim 26, further comprising:

a skylight flashing for placement on the roof, the flashing defining a top edge defining a diameter;

an upper support ring including a skirt formed with at least one radially protruding upper tab, the upper support ring being engaged with the flashing; and a skylight tube assembly formed with at least one upper notch for receiving the at least one upper tab therein to snappingly engage the skylight tube assembly with the upper support ring.

33. The skylight assembly of claim 31, further comprising:

a transparent cover covering the tube assembly; and an upper seal ring sandwiched between the skirt of the upper support ring and the transparent cover, wherein the upper seal ring is formed with at least one cover wiper surface for contacting an inner surface of the cover and at least one ring wiper surface for contacting the skirt of the upper support ring, the top edge of the flashing abutting the upper seal ring between the wiper surfaces.

34. The skylight assembly of claim 31, further comprising:

a transparent cover covering the tube assembly; and at least one fastener defining a head and a shank, the fastener interconnecting the cover and the flashing, a spacer being disposed around the shank between the head and the flashing to facilitate the absorption of thermal expansion in the skylight assembly.

* * * * *